United States Patent [19]

Palac

[11] 3,978,562

[45] Sept. 7, 1976

[54] METHOD OF MANUFACTURING A COLOR CATHODE RAY TUBE

[75] Inventor: Kazimir Palac, Carpentersville, Ill.

[73] Assignee: Zenith Radio Corporation, Chicago, Ill.

[22] Filed: May 1, 1975

[21] Appl. No.: 573,692

Related U.S. Application Data

[62] Division of Ser. No. 446,845, Feb. 28, 1974, Pat. No. 3,935,036.

[52] U.S. Cl. ..... 29/25.15; 29/25.13

[51] Int. Cl.[2] ..... H01J 9/18

[58] Field of Search ..... 29/25.13, 25.15; 316/17–20; 313/402, 404

[56] References Cited

UNITED STATES PATENTS

| | | | |
|---|---|---|---|
| 3,381,347 | 5/1968 | Reinwall, Jr. | 29/25.13 |
| 3,497,746 | 2/1970 | Duistermaat et al. | 313/404 |

*Primary Examiner*—Richard B. Lazarus
*Attorney, Agent, or Firm*—John H. Coult

[57] ABSTRACT

This disclosure depicts a method of manufacturing a novel rectangular-type color cathode ray tube which insures that a phosphor screen pattern deposited on an inner surface of the tube faceplate is accurately referenced to the source of electron beams for the tube. In the fabrication of a rectangular-type color cathode ray tube which comprises a faceplate having a phosphor screen pattern deposited on an inner surface thereof, a funnel adapted to be sealed to said faceplate and a neck for receiving electron gun means which is sealed to said funnel, a method for referencing said screen pattern on said faceplate to an effective source of electron beams generated by the electron gun means. The method comprises 1) providing on the funnel a plural number of spaced inside funnel reference surfaces; 2) providing inside referencing means on the faceplate which define a plural number of inside faceplate reference surfaces spaced and located to engage the inside funnel reference surfaces when the faceplate and funnel are assembled, the inside faceplate and funnel reference surfaces being of such a number and arrangement as to uniquely determine and fix the location of the faceplate relative to said funnel; 3) depositing a phosphor screen pattern on an inner surface of the faceplate with reference to the inside faceplate reference surfaces; 4) attaching the neck to the funnel with the neck center line referenced to the inside funnel reference surfaces; and 5) sealing the faceplate to the funnel, including bringing the inside faceplate reference surfaces and the inside funnel reference surfaces into referencing engagement during the sealing operation to thereby reference the screen pattern on the faceplate to the neck center line and thus to the effective source of electron beams generated by electron gun means ultimately mounted on the center line of the neck.

6 Claims, 20 Drawing Figures

72
74
12
78
100
80
76
14
84
82
102
19
20
21
98
90
86
92
96
88
94

METHOD OF MANUFACTURING A COLOR CATHODE RAY TUBE

CROSS-REFERENCE TO RELATED APPLICATIONS

This application is a division of copending application Ser. No. 446,845, filed Feb. 28, 1974 now U.S. Pat. No. 3,935,036, issued Jan. 27, 1976 and relates to, but is not dependent upon, copending applications Ser. No. 498,836, filed Aug. 19, 1974, Ser. No. 395,334, filed Sept. 7, 1973 now U.S. Pat. No. 3,912,963, issued Oct. 14, 1975, Ser. No. 428,176, filed Dec. 26, 1973 now U.S. Pat. No. 3,890,526, issued June 17, 1975 and Ser. No. 424,017, filed Dec. 12, 1973, now U.S. Pat. No. 3,896,321, issued July 22, 1975 all having a common assignee herewith.

BACKGROUND OF THE INVENTION

This invention relates to an improved method for making a novel color cathode ray tube of a rectangular type having a flangeless faceplate and a color selection electrode, which insures that a phosphor screen pattern deposited on the faceplate inner surface is accurately referenced to the source of electron beams for the tube. "Phosphor screen pattern " is herein intended to mean a pattern of interleaved arrays of red-emissive, blue-emissive and green-emissive cathodo-luminescent elements and, in tubes of the negative guardband type, the associated "black grille."

Conventional color cathode ray tubes have a glass envelope which comprises a flanged front panel sealed to a funnel. The front panel flange has embedded in its inner surface a plurality of studs which serve to support a color selection electrode adjacent to a phosphor screen pattern deposited on the inner surface of a faceplate section of the front panel. A neck for housing electron guns for the tube is sealed to the funnel.

It is critical to proper tube operation that the phosphor screen pattern and the aperture pattern of the associated color selection electrode be aligned with respect to the effective source of electron beams in the assembled tube in the same way that they were aligned with respect to the effective point source used in the photo-exposure operations employed to form the screen. If this corresponding relative alignment is not achieved, color purity errors will inevitably be exhibited in the images displayed by the end product tube.

In conventional tubes, the necessary referencing of the phosphor screen and the effective source of electron beams is established by the following method. The conventional referencing method will be best understood if the reader keeps in mind the general principle that two things referenced to a third thing are referenced to each other.

It is conventional during the photoscreening operations in which the phosphor arrays (and the black grille in negative guardband tubes) are deposited, to reference the front panel to three external reference points, typically three rigid posts against which the front panel is urged during the photoscreening operations. Thus, the screen pattern is deposited on the faceplate with reference to three fixed, known reference points. This referencing principle is portrayed in FIG. 1 wherein R represents the fixed external reference (the three reference posts), and reference line $RL_a$ represents the referencing of the screen pattern 2 on faceplate portion 3 of a front panel 4 to the reference R.

During sealing of the neck 5 to the funnel 6 (depicted diagrammatically in FIG. 2) the effective source 7 of electron beams generated by the electron guns (shown schematically as 8), i.e., the apparent "center of deflection" of the beams, is referenced to three corresponding external reference points. More particularly, in conventional practice the neck 5 is sealed to the funnel 6 in a glass-to-glass sealing operation. The center line C/L of the neck 5 (on which the effective source 7 of electron beams will ultimately lie) is then referenced to the said three corresponding external reference points by grinding reference surfaces 9 (commonly termed "pads") on the outside surface of the funnel to the required high degree of accuracy (typically about ± 12 mils tolerance). The neck center line 8 and effective source 7 of electron beams are thus referenced to reference R, as represented by reference line $RL_b$.

To assemble a conventional tube according to conventional practice, a sealing fixture is employed which has in an upper plane three carbon buttons defining three reference points which correspond in location to the afore-described three reference points used in photoscreening the front panel. These panel referencing buttons engage and position the front panel during the funnel-panel sealing operation. In a lower plane, a similar set of three funnel referencing buttons are provided which are aligned with respect to the panel referencing buttons and which are positioned to engage the three external reference surfaces 9 ground on the funnel 6. Such a fixture is described in U.S. Pat. No. 3,737,065.

To seal a conventional funnel and front panel, a frit-type solder glass is deposited on the funnel seal land and the funnel is placed in a fixture, such as described, with the funnel bearing against the said three panel referencing buttons. The front panel is placed on the funnel against the three panel referencing buttons. Since the panel referencing buttons and the funnel referencing buttons are aligned with respect to each other and can be considered as a single reference, it can be understood that the screen pattern on the front panel is thus referenced to the center line of the tube neck and thereby to the effective source of electron beams when the electron gun is ultimately assembled in the tube neck.

The referencing principles which apply to the described panel-funnel sealing operation are shown diagrammatically in FIG. 3. It can be seen that since the screen pattern 2 and neck center line are both referenced to the same external reference R, they are therefore referenced to each other.

The described conventional method for assembling conventional color tube envelopes accomplishes referencing of the phosphor screen pattern to the effective source of electron beams and is satisfactory from a performance and yield standpoint when the sealing fixtures are in good working condition — yet, the conventional method has a number of drawbacks. Note in FIG. 3 that the external reference R (the six reference buttons on the conventional sealing fixture) must be preserved during the panel-funnel sealing operation. These sealing fixtures are subjected to extreme temperature cycling as they are heated and cooled during the frit sealing operation. The temperature cycling of these fixtures inevitably results in accuracy degradation with resultant high maintenance cost and decrease in yield of the sealing operation due to referencing accuracy losses. Also, the described conventional referencing method requires that high accuracy reference surfaces be ground on the funnel, an operation which adds to the cost of the end product tube.

Prior Art

U.S. Pat. Nos. 2,755,405 - Wilhelm, 3,497,746 - Duistermaat et al.

Wilhelm and Duistermaat et al each disclose a glass funnel having formed integrally therein one or more recesses for receiving spring-type shadow mask suspension members.

OTHER PRIOR ART

U.S. Pat. Nos. 2,514,878, 2,761,990, 2,916,644, 3,285,457, 3,369,881, 3,450,920, 3,548,235.

OBJECTS OF THE INVENTION

It is a general object of this invention to provide an improved method of fabricating an improved color cathode ray tube of the type having a color selection electrode which insures that the phosphor screen pattern is accurately referenced to the source of electron beams for the tube.

It is another object to provide an improved color cathode ray tube fabrication method of the character described which yields economies in tube cost.

It is still another object to provide an improved method for fabricating a color cathode ray tube which permits, in the frit sealing operation, the use of a sealing fixture which as no accuracy or alignment constraints upon it, and thus which has relatively low capital cost and greatly reduced upkeep.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
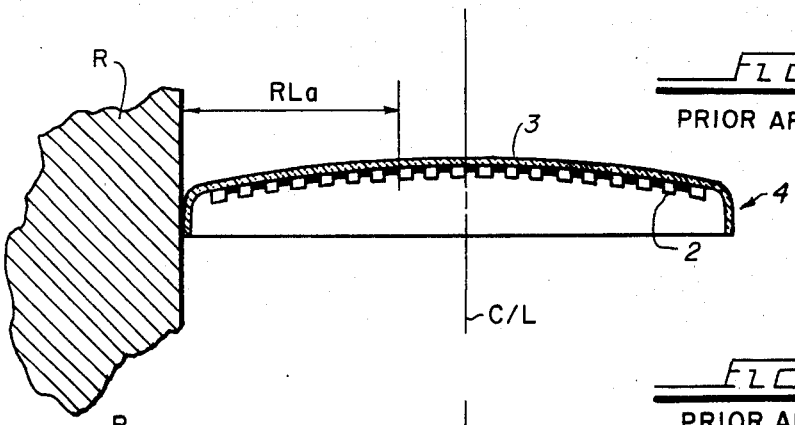
FIG-1 PRIOR ART
FIGS. 1–3 diagrammatically depict a conventional method for referencing the screen pattern on the front panel of a color cathode ray tube to the effective source of electron beams in the assembled tube.

FIGS. 4–7 depict a novel color cathode ray tube which may be constructed according to the method of this invention. In conventional shadow mask-type color tubes, the color selection electrode is supported by studs embedded in the inner surface of a flange provided on the tube faceplate or "front panel." These studs do not play a direct part in the referencing of the phosphor screen pattern and the effective source of electron beams. Rather, referencing is accomplished using an external reference, as described above. At the heart of the invention of the parent application is the provision of means projecting from the faceplate portion of a cathode ray tube envelope to serve a dual function: 1) to define reference surfaces which mate with reference surfaces in the funnel during the faceplate-funnel sealing operation to assume referencing of the screen pattern on the faceplate (and the associated color selection electrode) to the effective source of electron beams in the end product tube, and 2) in the preferred embodiments, to support a color selection electrode adjacent the faceplate.

This invention is most advantageously implemented in connection with rectangular color tubes of a novel type having a flangeless faceplate which is sealed directly to the mouth of the funnel, such as is shown, e.g., in FIGS. 4—7. The FIGS. 4–7 tube is illustrated as comprising a flangeless, spherically contoured faceplate 10 which mates with and is sealed to a funnel 12. A neck 14 is sealed to the funnel 12. In accordance with the invention of the parent application, the funnel 12 has, or is provided with a plurality of inside reference surfaces or aras located within the mouth region of the funnel 12.

In the illustrated FIGS. 4–7 tube, the plurality of reference surfaces are shown as comprising three reference surfaces 16, 17 and 18, the surfaces 16 and 17 being corner surfaces in one corner of the funnel, and the surface 18 being disposed in an adjacent corner of the funnel 12. As used herein, the funnel "reference surfaces" may be designated surface areas on an otherwise unmodified funnel, or flats molded integrally into the funnel or, as shown in the FIGS. 4–7 embodiment, may be surfaces on bosses 19, 20 and 21, molded integrally into the funnel. Alternatively, the funnel reference surfaces may be provided by auxiliary structures mounted within the funnel.

The faceplate 10 includes in corresponding corners, referencing means defining a plurality of faceplate reference surfaces for mating with the afore-described funnel reference surfaces 16, 17 and 18. The referencing means are shown in the FIGS. 4–7 tube in the form of studs 22, 23, 24 and 25 which serve also to support a color selection electrode 26 adjacent the inner surface of the faceplate 10 on which is deposited a screen pattern 28. Stud 22 is shown enlarged in FIG. 4A. The studs 22–25 are located in the faceplate diagonals and are perpendicular thereto. As shown clearly in FIG. 5, when the faceplate 10 is sealed to the funnel 12, two edges of the stud 22, hereinafter termed the faceplate reference surfaces 30 and 32, engage the funnel reference surfaces 16 and 17 to define two reference points. The third reference point is defined by the engagement of an edge of stud 25, acting as faceplate reference surface 34, with the funnel reference surface 18.

The novel studs 22–25 do not, per se, constitute a part of this invention, but are described and claimed in my referent U.S. Pat. No. 3,890,526.

As stated, in accordance with a preferred implementation of the principles of this invention, the referencing means (studs 22–25 in FIGS. 4–7) have plural functions. Consider particularly FIGS. 4, 6 and 7 which show the studs 22–25 as constituting part of suspension devices 35 for supporting the color selection electrode 26. Neither the color selection electrode 26 nor the suspension devices 35, per se, constitute a part of this invention. The electrode is described and claimed in the referent copending application Ser. No. 498,836 and U.S. Pat. No. 3,912,936; the suspension devices 35 are described and claimed in the referent U.S. Pat. No. 3,896,321 and others.

Briefly, the color selection electrode 26 is illustrated as comprising a one-piece, frameless mask having integral means for stiffening the electrode and for shielding the screen from overscanned and stray electrons. The suspension devices 35 are located at the corners of the electrode 26 and each comprise brackets 36 supporting a spring-biased lug 37 which retentively engages an aperture in the mating stud.

It is an aspect of this invention to provide, in the fabrication of a color cathode ray tube, an improved method for referencing a screen pattern on the tube faceplate to an effective source of electron beams for the tube. The method comprises, in broad terms, causing the funnel to be provided with three or more spaced, inside funnel reference surfaces. The faceplate is provided with inside referencing means defining a number of faceplate reference surfaces correspondingly spaced and located to engage the funnel reference surfaces when the faceplate and funnel are assembled. A pattern of cathodo-luminescent phosphor elements is deposited on an inner surface of the faceplate with reference to the faceplate reference surfaces. A neck is attached to the funnel with the neck center line referenced to the funnel reference surfaces. Finally, the faceplate is sealed to the funnel, the sealing operation including bringing the faceplate reference surfaces and the funnel reference surfaces into referencing engagement during the sealing operation. The screen pattern on the faceplate is thereby referenced to the neck center line and thus to the effective source of electron beams projected by electron gun means ultimately mounted on the center line of the neck.

Figure 8:
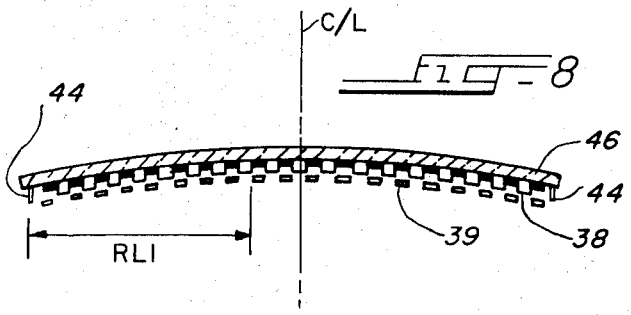
FIGS. 8–10 diagrammatically depict the method of this invention for referencing the screen pattern on the faceplate of a color cathode ray tube to the effective source of electron beams in the assembled tube.
Figure 9:
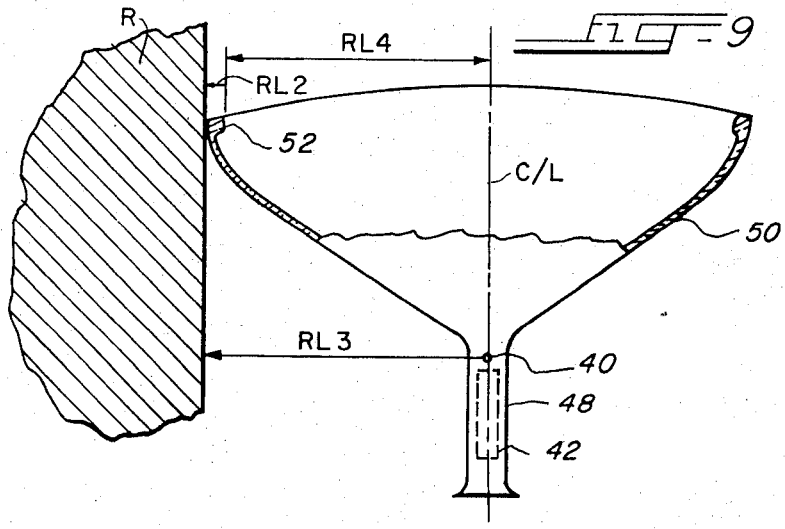
Figure 10:
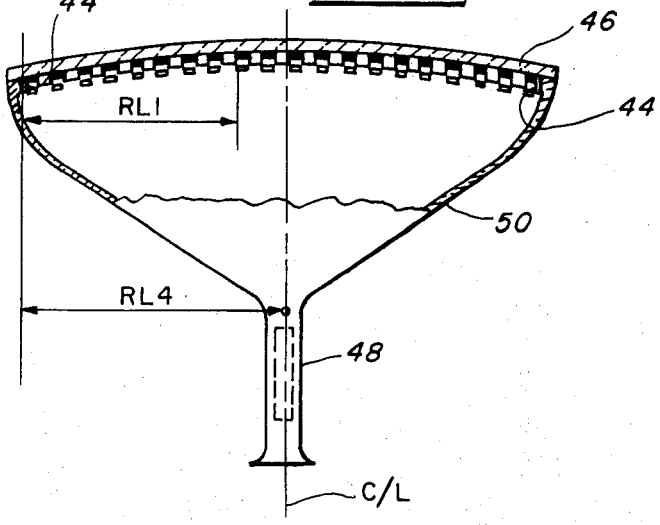

The referencing principles underlying this invention are revealed in FIGS. 8–10. FIGS. 8–10 illustrate diagrammatically the way in which a screen pattern 38 and an associated color selection electrode 39, are referenced to an effective source 40 of electron beams projected by electron gun means, shown schematically as 42. The referencing principles represented by each of FIGS. 8, 9 and 10 will be described in detail hereinafter.

FIG. 8 is intended to portray diagrammatically that the phosphor pattern 38 and the faceplate referencing means, preferably an electrode-supporting stud 44 embedded in faceplate 46, as described, are referenced to each other, as represented by reference line $RL_1$.

In the sealing of a neck 48 to a funnel 50, the center line C/L of the neck (on which will lie the effective source 40 of electron beams), and the funnel reference surfaces 52 are both referenced to a common external reference R. The effective electron source 40 and the reference surface 52 are thus referenced to each other. See FIG. 9; the referencing of the reference surface 52 to the external reference R is represented by reference line $RL_2$ and the effective source 40 to reference R by line $RL_3$. The mutual referencing of reference surface 52 and effective source 40 is represented by reference line $RL_4$.

During assembly of the tube, the stud 44 is brought into referencing engagement with the reference surface 52 to reference the faceplate 46 to the funnel 50. The screen pattern 38 and associated color selection electrode 39 are thus referenced to the center line of the neck 48 and thereby to the effective electron source 40.

Figure 2:
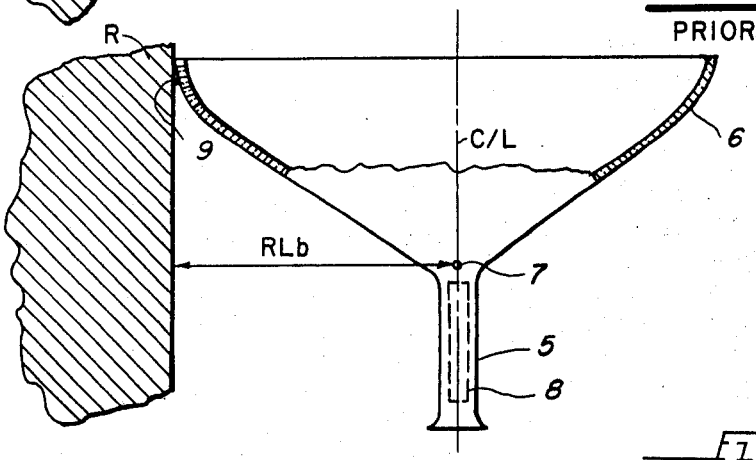
FIG-2 PRIOR ART
Figure 3:
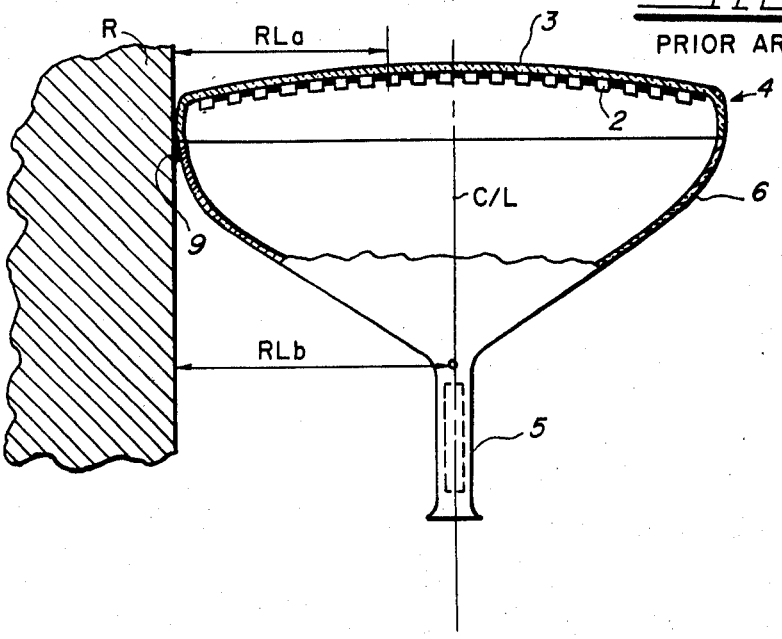
FIG-3 PRIOR ART
Figures 4, 4A, 5:
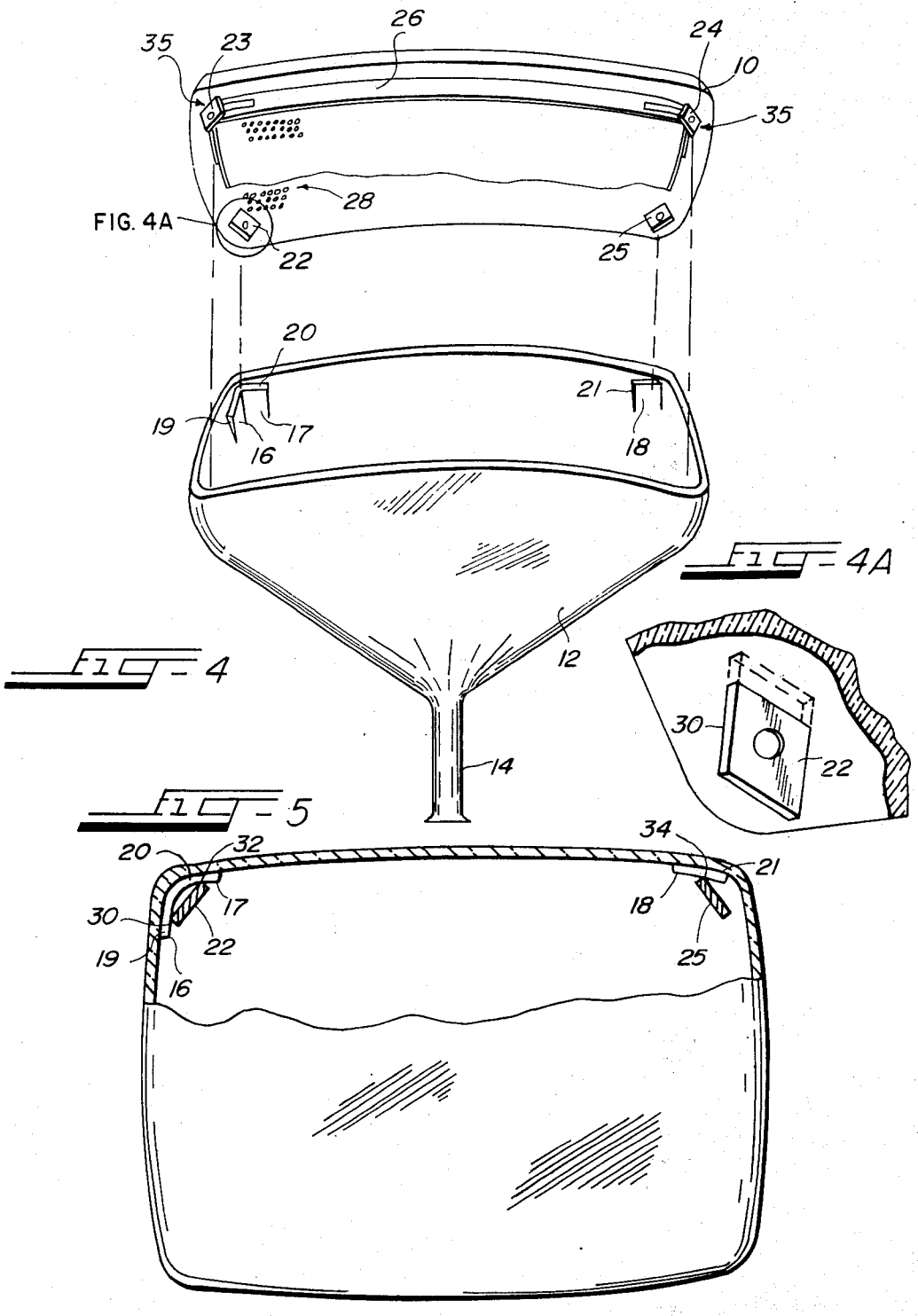
FIG. 4 is an exploded, schematic, partially fragmented view of components of a color cathode ray tube constructed according to the method of this invention.
FIG. 4A is an enlarged view of a component of the FIG. 4 tube.
FIG. 5 is a plan view of the FIG. 4 tube, assembled and partly broken away.
Figure 6:
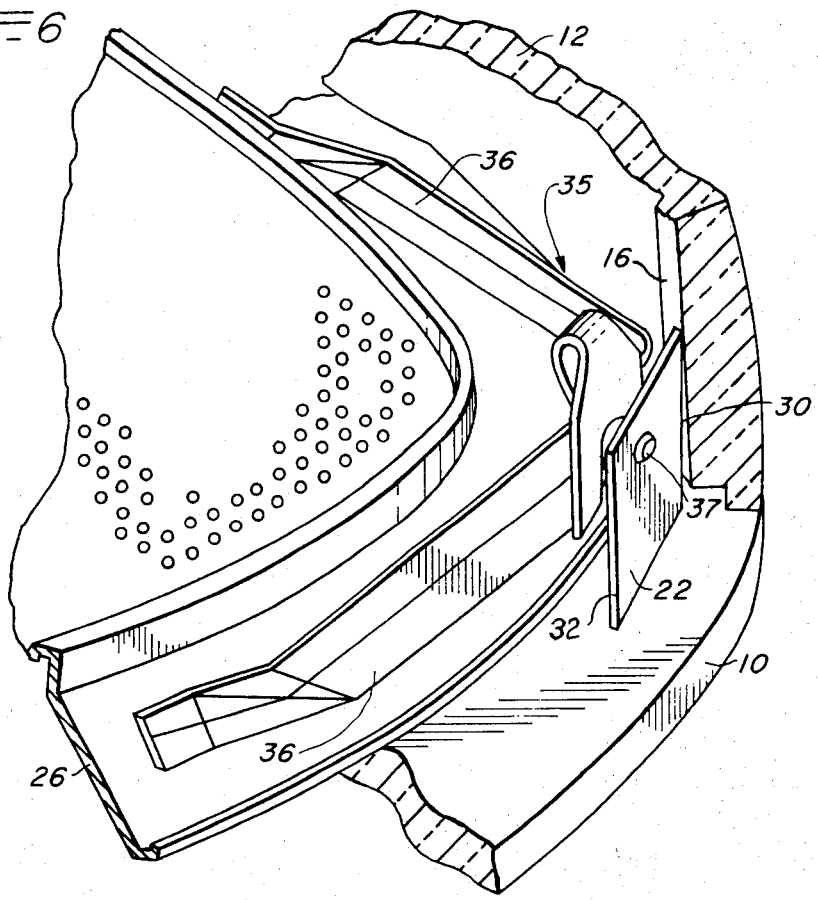
FIGS. 6 and 7 are enlarged perspective views, with parts broken away, of a corner of the assembled FIGS. 4 and 5 tube, showing in particular the suspension system for suspending the color selection electrode in the tube.
Figure 7:
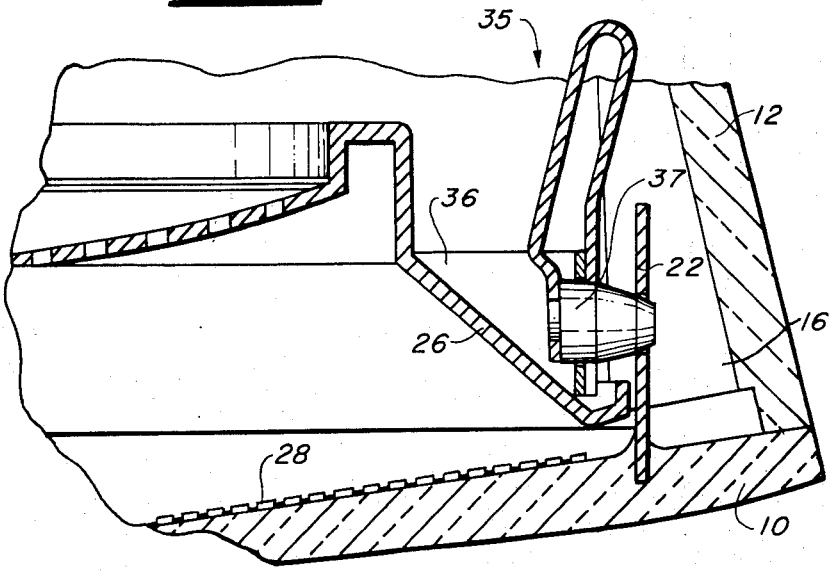

It is informative at this point to compare the FIGS. 8–10 diagrams with the corresponding FIGS. 1–3 diagrams which depict the conventional referencing principles. Note that whereas in the conventional method (FIGS. 1–3) it is necessary to carry the external reference R through the panel-funnel sealing operation (FIG. 3), referencing is accomplished within the tube in the method of this invention (FIG. 10). No external reference need be carried through the sealing operation. As noted above, the result is substantial savings in fixture-associated expenses, and improved referencing accuracy.

Figure 11:
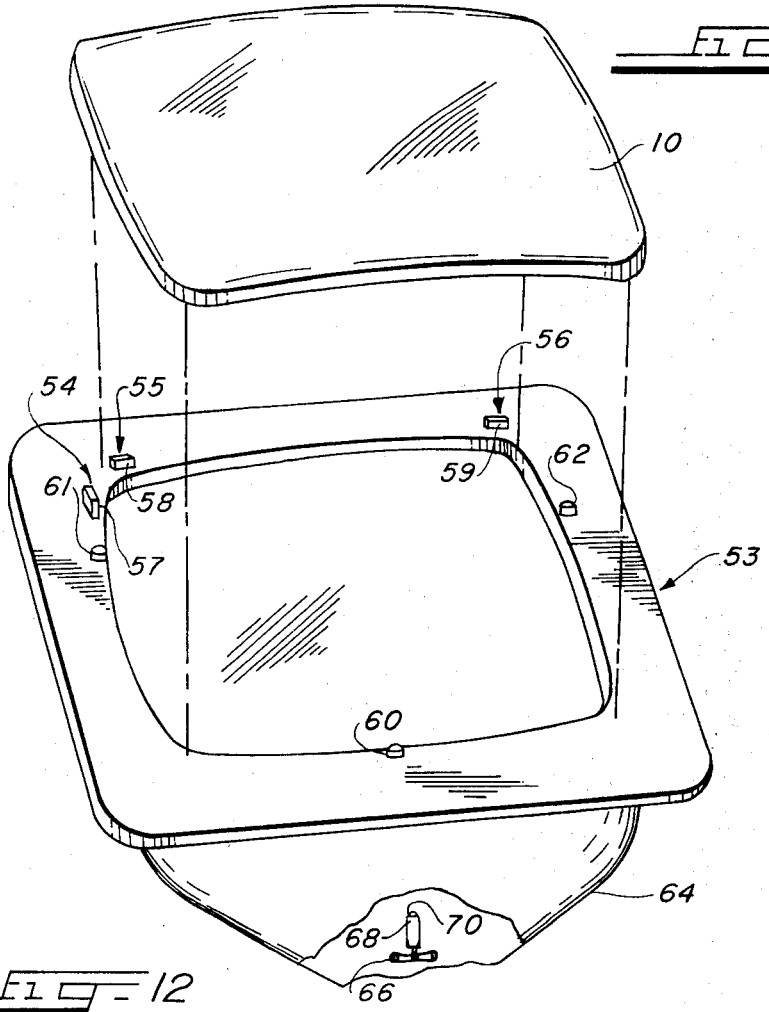
FIG. 11 is a schematic, partially exploded view of an exposure table for exposing a faceplate according to a method of this invention.
Figure 12:
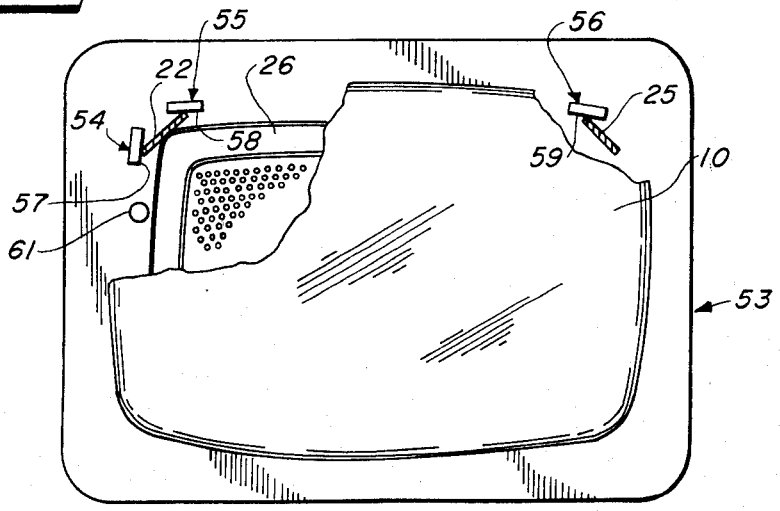
FIG. 12 is a view of the FIG. 11 exposure table with the faceplate and attached color selection electrode in place, a portion of the faceplate being broken away to reveal hidden internal components.

The referencing principle depicted diagrammatically in FIG. 8 is illustrated in schematic, but more structural form in FIGS. 11 and 12. The following discussions of FIGS. 11–16 will be made with reference to the FIGS. 4–7 tube shown and described above. As explained, in the photoscreening of the screen pattern 28 on faceplate 10, it is desired to reference the screen pattern 28 (and associated color selection electrode 26) to the studs 22–25. This is accomplished as follows. The studs 22–25 are placed on the faceplate 10 with high accuracy relative to each other and with general relation to three external points which establish the center of a bogey panel.

The phosphor pattern 28 is photochemically deposited on the inner surface of the faceplate with reference to the studs 22–25 by the use of an exposure table, which may be of the construction shown schematically in FIG. 11 as 53. The exposure table 53 includes posts 54, 55 and 56. The posts define three internal reference surfaces 57, 58 and 59 which correspond to the funnel reference surfaces 16, 17 and 18, respectively. The faceplate 10 is supported by supports 60, 61 and 62. During the photoscreening operation, the studs 22 and 25 are urged against reference surfaces 57–59 on posts 54–56 such that the phosphor pattern 28 created is referenced to the studs 22–25.

The exposure table 54 may be substantially conventional, including an exposure chamber 64 and a point source of UV light. The point light source is illustrated as comprising a mercury lamp 66 irradiating a collimator 68 which concentrates the received light into a small effective point source at its tip 70.

The funnel referencing principles will now be described. As explained, during sealing of the neck to the funnel, the neck center line and the funnel reference surfaces are both referenced to a common reference and are thus referenced to each other. In the practice of this invention, rather than referencing the neck center line to pads ground externally on the funnel periphery as in the conventional practice (see 8 in FIG. 2), the neck center line is referenced to the internal funnel reference surfaces, such as surfaces 16–18 (see FIG. 4).

Figures 13, 14:
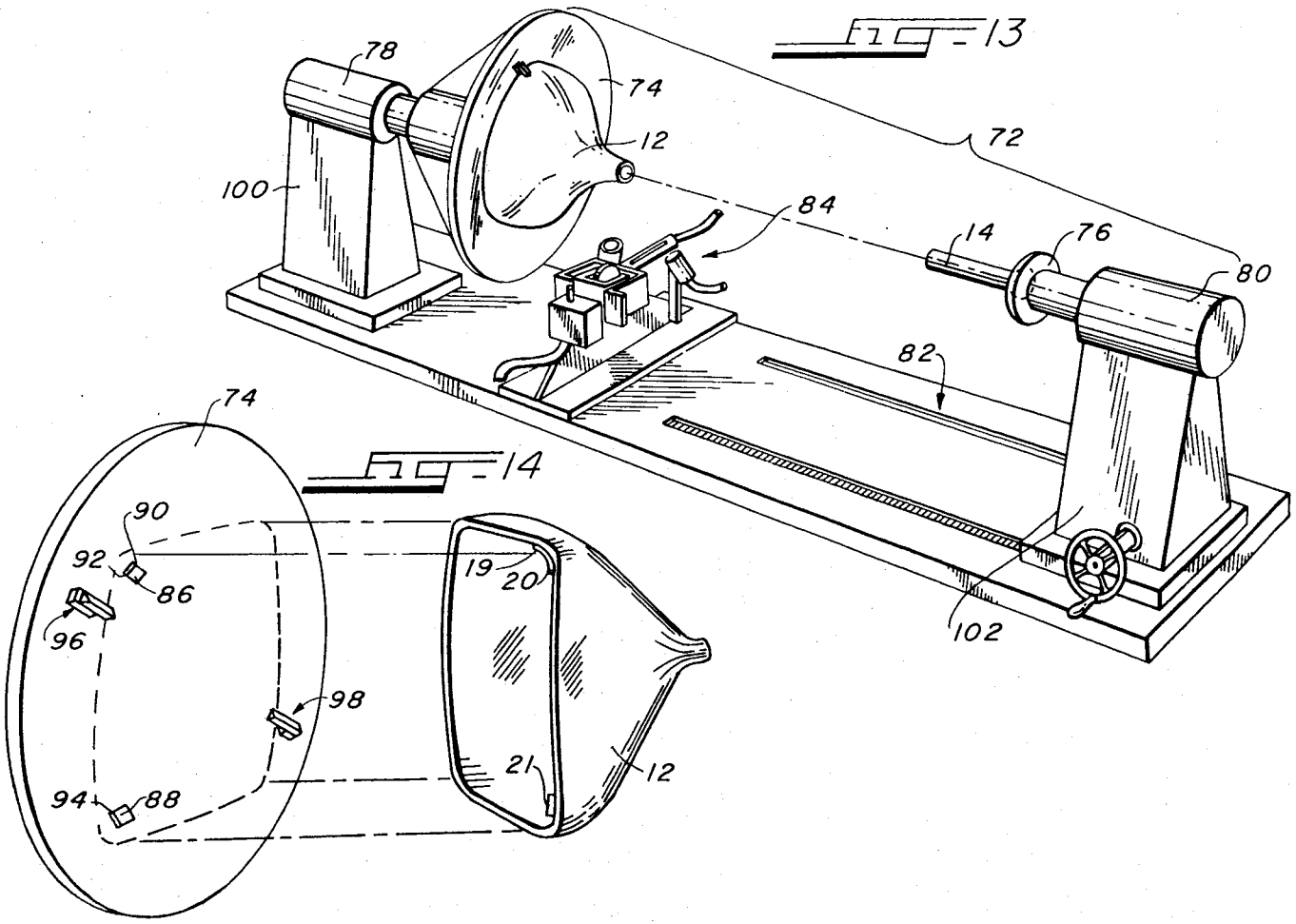
FIG. 13 is a somewhat schematic perspective view of a neck seal lathe for sealing a cathode ray tube neck and funnel to implement a referencing method according to this invention.
FIG. 14 is an enlarged view of a funnel support head comprising part of the FIG. 13 lathe with the funnel exploded from the head to show hidden referencing structures on the faceplate of the head and on the inside of the funnel.

Referring to FIGS. 13 and 14, referencing of the neck center line to the funnel reference surfaces 16–18 may be accomplished by means of a neck seal lathe 72. The lathe 72 is shown as comprising a funnel support head 74 and a neck chuck 76 which are rotated in a common direction at a common speed by motors 78 and 80. The neck chuck 76 is moved linearly along a track assembly 82 to bring the neck 14 into engagement with the funnel 12. A burner assembly 84 produces a flame which is played upon the funnel-neck joint as the funnel and neck are rotated together in coaxial mating engagement to effect a glass-to-glass seal of the neck to the funnel.

In order to reference the funnel reference surfaces 16–18 and the neck center line to a common reference, the funnel 12 is positioned on the funnel support head 74 in referencing engagement with bosses 86, 88 having edges defining reference surfaces 90, 92 and 94. See especially FIG. 14. The reference surfaces 90, 92 and 94 correspond in position to the reference surfaces 30, 32, 34 on studs 22 and 25. A pair of pivoted clamping levers 96, 98 are employed to hold the funnel 12 and to maintain it in referencing engagement with the bosses 86, 88. The clamping levers may be controllable by pneumatic pistons, for example (not shown).

The funnel support head 74 and the neck chuck 76 are positioned and maintained in exact coaxial alignment by associated support structures 100, 102 and the track assembly 82. The reference surfaces 16–18 and the neck center line are thus referenced to each other.

Figure 15:
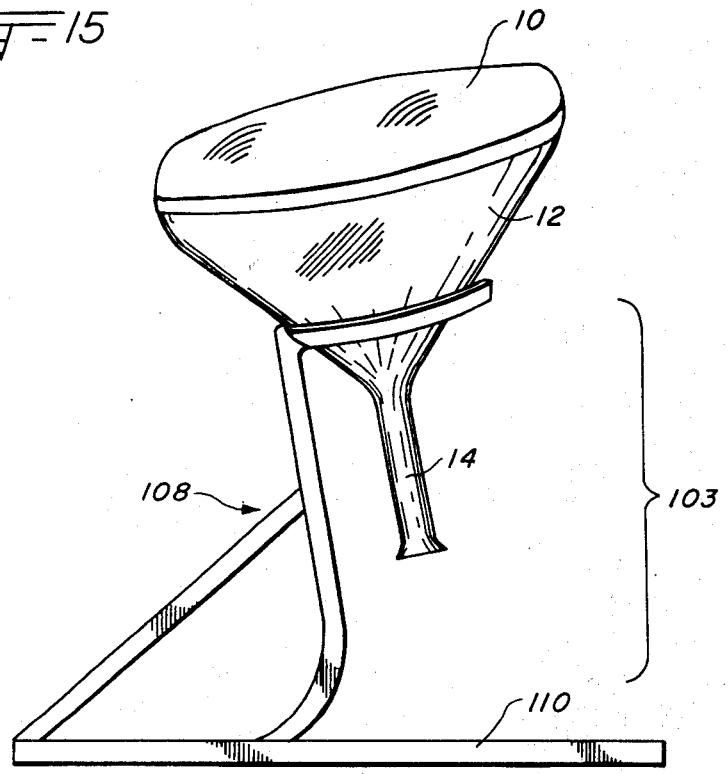
FIGS. 15 and 16 illustrate a simplified frit sealing fixture made possible by application of the principles of the present invention.
Figure 16:
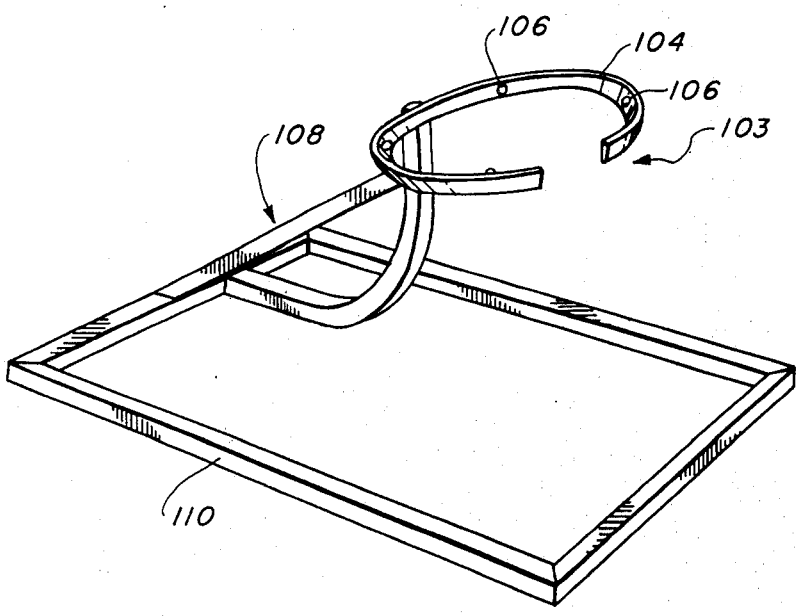

As explained, by sealing the faceplate 10 and funnel 12 with the studs 22 and 25 in referencing engagement with the reference surfaces 16–18, the screen pattern 28 (and associated color selection electrode 26) and the center line of the neck 14 are referenced to each other. The sealing operation, per se, may be conventional in the duration and temperature of the bake cycle, the oven employed, and other such details. As noted, however, this invention permits the use of an economical sealing fixture 103, such as shown in FIGS. 15–16. FIG. 15 depicts an assembled tube as it would appear during the frit seal baking operation.

To seal the faceplate 10 and funnel 12, the color selection electrode 26 is attached to the faceplate 10. A quantity of frit-type solder glass is placed on the seal land at the mouth of the funnel 12, and the funnel 12 is placed in the fixture 103. The faceplate-funnel assembly is placed in an oven suitable for the frit sealing operation. The fixture 103 orients the funnel 12 during the frit sealing operation such that the funnel tilts in a direction so that the corner diagonally opposite reference surfaces 16 and 17 is the lowest corner, and the corner diagonally opposite reference surface 18 is the next lowest corner. By thus tilting the faceplate-funnel assembly, the gravitational force will hold studs 22 and 25 in referencing engagement with the reference surfaces 16–18 during the frit sealing operation.

It can be seen in FIG. 16 that the frit sealing fixture 103 may comprise simply a C-ring 104 having four carbon buttons 106 for engaging the funnel; the C-ring 104 is supported by an arm assembly 108 attached to a base 110. Since referencing is accomplished within the tube envelope, the external referencing buttons provided in prior art fixtures, such as shown in the U.S. Pat. No. 3,737,065, are unnecessary. The result is a fixture having reduced initial cost and greatly reduced maintenance expense.

Figure 17:
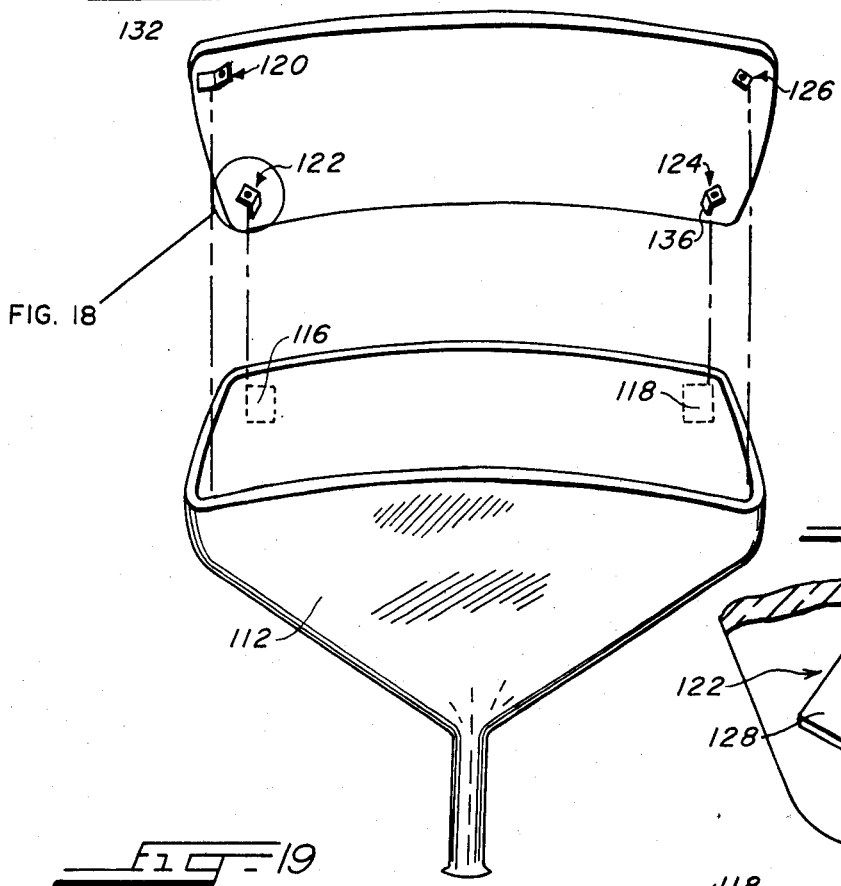
FIGS. 17, 18 and 19 corresponding to FIGS. 4, 4A and 5, and reveal an alternative color CRT which may be constructed according to the method of this invention.
Figure 18:
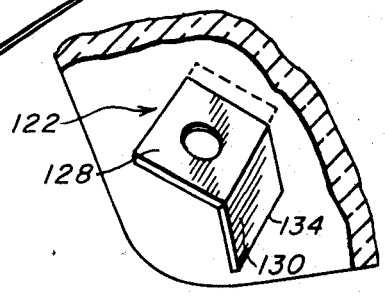
Figure 19:
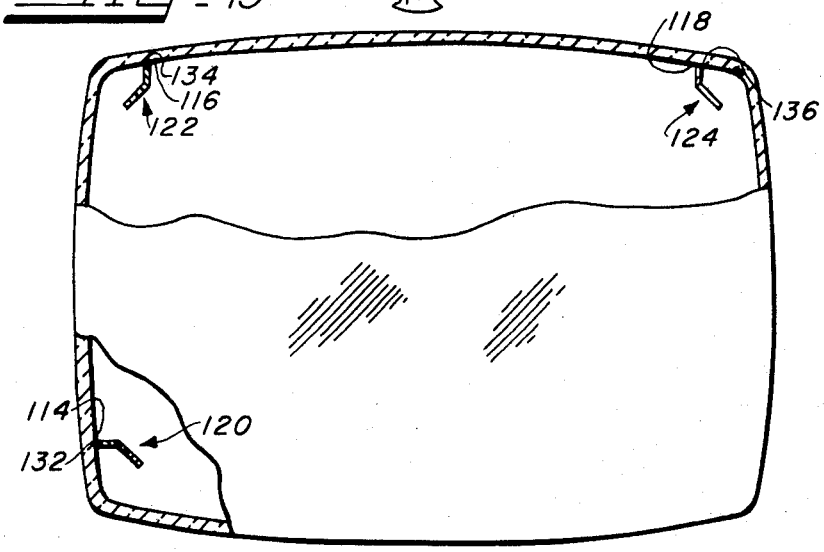

As suggested above, bosses molded integrally into the funnel 12 may be used to define the internal reference surfaces; alternatively, the reference surfaces may comprise designated areas on an unmodified funnel, or flats molded into the inner surface of the funnel. A modification having molded flats is shown in FIGS. 17–19. In this embodiment a funnel 112 is provided with reference areas 114, 116 and 118 in three corners which constitute internal referencing surfaces functioning as the reference surfaces 16–18 in the above-described embodiment. In this embodiment, the referencing projections are again preferably, but not necessarily, studs 120, 122, 124, 126 which serve also to support a color selection electrode of the tube.

Referring particularly to FIG. 18, the studs 120–126 preferably are formed with a body portion 128 generally similar to the studs 22–25 in the first-described embodiment. Studs 120–124 each have, however, a wing 130 extending obliquely outwardly from the body portion 128. The wings 130 define faceplate reference surfaces 126, 128 and 130 which make referencing engagement with the reference areas 114, 116 and 118. Fabrication of a tube having the modified structures shown in FIGS. 17–19 may be as described above.

The invention is not limited to the particular details of construction of the embodiments depicted and other modifications and applications are contemplated. For example, in the illustrated and described preferred method, to reference the phosphor pattern to the studs, the studs are placed on the faceplate with relation to the center of a bogey panel, and the phosphor pattern is then exposed in an exposure table having internal reference surfaces against which the studs make referencing engagement. Alternatively, the phorphor pattern may be referenced to the studs by locating both the studs on the panel and the phosphor pattern on the panel with respect to a common external reference such as three reference posts. Still other changes may be made in the above-described methods without departing from the true spirit and scope of the invention herein involved and it is intended that the subject matter in the above depiction shall be interpreted as illustrative and not in a limiting sense.

What is claimed is:

1. In the fabrication of a rectangular-type color cathode ray tube which comprises an approximately rectangular, flangeless faceplate having a phosphor screen pattern deposited on an inner surface thereof, a funnel having an approximately rectangular mouth adapted to be sealed to said inner surface of said faceplate, and an elongated cylindrical neck sealed to said funnel on the center line of the tube for receiving electron gun means, a method for referencing said screen pattern on said faceplate to an effective source of electron beams generated by the electron gun means, comprising:

providing in at least two interior corner regions of said funnel mouth a total of at least three spaced insided funnel reference surfaces oriented parallel to said center line;

providing in at least two interior corner regions of said faceplate corresponding to said corner regions of said funnel mouth inside referencing means which extend from said inner surface of the faceplate and which define at least three tangentially spaced, axially oriented inside faceplate reference surfaces so located as to engage said inside funnel reference surfaces when the faceplate and funnel are assembled, the engagement of said inside faceplate and funnel reference surfaces uniquely determining and fixing the azimuthal attitude of said faceplate relative to said funnel in a plane generally perpendicular to said center line;

depositing a phosphor screen pattern on said inner surface of said faceplate in a location and with an orientation which bears a predetermined reference to said inside faceplate reference surfaces;

attaching said neck to said funnel with the neck center line oriented to bear a predetermined reference to said inside funnel reference surfaces; and sealing said faceplate to said funnel, including bringing said inside faceplate reference surfaces and said inside funnel reference surfaces into referencing engagement during the sealing operation to thereby reference said screen pattern on said faceplate to said neck center line and thus to the effective source of electron beams generated by electron gun means ultimately mounted on the center line of the neck.

2. The method defined by claim 1 wherein said step of providing funnel reference surfaces comprises causing the funnel to be molded from glass such as to have reference surfaces or areas in corner regions thereof which are adapted to be engaged by said faceplate reference surfaces.

3. The method defined by claim 2 wherein said funnel is molded to have bosses extending inwardly from an inner surface thereof to present said reference surfaces.

4. The method defined by claim 2 wherein said funnel is molded to have flats on an inner surface thereof which constitute said funnel reference surfaces.

5. The method defined by claim 1 wherein said step of attaching said neck comprises supporting said funnel and said neck in co-axial alignment, said funnel reference surfaces and the center line of said neck both being referenced to a common assembly axis whereby upon sealing of said funnel and said neck, said funnel reference surfaces are referenced to said neck center line.

6. The apparatus defined by claim 1 wherein said providing of inside referening means on the faceplate comprises affixing to said faceplate in each of at least two corner regions thereof a stud which serves also to support a color selection electrode for the tube, said studs collectively defining said three inside faceplate reference surfaces.

* * * * *